US006012844A

United States Patent [19]

Huseman et al.

[11] Patent Number: 6,012,844

[45] Date of Patent: Jan. 11, 2000

[54] SELECTIVELY CLOSEABLE PLASTIC FILM BAG

[76] Inventors: David C. Huseman, 2024 Valley Ct., Brentwood, Tenn. 37027; George Pappas, 2102 Forest Park Blvd., Fort Wayne, Ind. 46805

[21] Appl. No.: 09/251,276

[22] Filed: Feb. 16, 1999

[51] Int. Cl.[7] ..... B65D 33/18

[52] U.S. Cl. ..... 383/93; 383/5; 383/40; 383/209

[58] Field of Search ..... 383/5, 93, 95, 383/210, 211, 40, 207, 209; 229/80, 80.5

[56] References Cited

U.S. PATENT DOCUMENTS

| | | | |
|---|---|---|---|
| 2,819,010 | 1/1958 | Amiguet . | |
| 2,991,001 | 7/1961 | Hughes . | |
| 3,070,280 | 12/1962 | Richmond . | |
| 3,456,867 | 7/1969 | Repko . | |
| 3,625,414 | 12/1971 | Caiola . | |
| 3,669,254 | 6/1972 | Chrysanthis . | |
| 3,889,871 | 6/1975 | White . | |
| 4,402,453 | 9/1983 | Regenstein, Jr. . | |
| 4,580,683 | 4/1986 | Gochenow . | |
| 4,679,688 | 7/1987 | Soderhold . | |
| 4,720,040 | 1/1988 | Gurewitz . | |
| 4,759,643 | 7/1988 | Canno . | |
| 4,785,940 | 11/1988 | Wilson . | |
| 4,786,190 | 11/1988 | Van Erden . | |
| 4,932,791 | 6/1990 | Vetter . | |
| 4,941,196 | 7/1990 | Edelman et al. . | |
| 4,961,503 | 10/1990 | Bell . | |
| 4,988,547 | 1/1991 | Voto, Jr. et al. . | |
| 5,026,174 | 6/1991 | Blatt . | |
| 5,030,189 | 7/1991 | Hightower . | |
| 5,044,772 | 9/1991 | Larson | 383/93 X |
| 5,046,621 | 9/1991 | Bell . | |
| 5,056,930 | 10/1991 | Mestesky . | |
| 5,102,234 | 4/1992 | Levy . | |
| 5,103,979 | 4/1992 | Hustad | 383/5 X |
| 5,108,194 | 4/1992 | Raden . | |
| 5,205,649 | 4/1993 | Fullerton . | |

FOREIGN PATENT DOCUMENTS

| | | | |
|---|---|---|---|
| 1282028 | 5/1962 | France . | |
| 2032882 | 5/1980 | United Kingdom . | |
| 2145997 | 4/1985 | United Kingdom . | |
| WO 79/00590 | 8/1979 | WIPO | 383/211 |

(List continued on next page.)

*Primary Examiner*—Jes F. Pascua
*Attorney, Agent, or Firm*—George Pappas

[57] ABSTRACT

A selectively closeable plastic film bag is formed with front and rear plastic film panels. The bag includes a bottom and side edges and each of the front and rear panels include a top edge whereat an opening is provided into the bag cavity. An adhesive strip is provided on the inside surface of the front or rear panels extending longitudinally thereacross between the bag side edges. The adhesive strip is placed in a pattern extending at an angle upwardly from each of the side edges to a generally linear portion therebetween. A release liner is provided between the front and rear panels and is located partially over or above the adhesive strip at the side edges and below the linear adhesive strip portion. The adhesive strip portion covered by the release liner is prevented from coming in contact with the other bag panel thereby retaining the bag open. The release liner is detachably attachable to the adhesive strip. For closing the bag, the release liner is pulled out from between the panels causing the adhesive strip to come in contact therewith. The adhesive strip extends uninterrupted from side edge to side edge thereby making the closure leakproof. Pocket panels are attached to the bag thereby forming pockets for selectively receiving items therein. The front and rear panels are provided with weakened material lines extending between the side edges for easily ripping and gaining access to the bag cavity. To prevent fusing of the release liner to the front and rear panels, both the release liner and front and rear panels are cut away at the bag side edges above the adhesive. The release liner extends above the front and rear panels top edges or into notched areas at the bag side edges whereat it may easily be gripped.

49 Claims, 4 Drawing Sheets

U.S. PATENT DOCUMENTS 5,253,754 10/1993 Soodak .
5,318,364 6/1994 Raden .
5,346,301 9/1994 Scarberry .
5,352,041 10/1994 Fullerton .
5,388,699 2/1995 Ratajczak .
5,476,323 12/1995 Gold .
5,533,624 7/1996 Soderholm .
5,549,388 8/1996 Wilkes .
5,584,580 12/1996 Vetter .
5,711,751 1/1998 Harmanoglu .
5,788,377 8/1998 Vetter .

SELECTIVELY CLOSEABLE PLASTIC FILM BAG

TECHNICAL FIELD

The present invention is directed to the technical field of plastic film bags commonly used for storing or retaining various products and things. More particularly, the present invention is directed to an improved plastic film bag having an opening which is selectively closeable and leakproof

BACKGROUND OF THE INVENTION

Plastic film bags are manufactured and very commonly used for holding and storing various types of items and things ranging from industrial and manufacturing items to edible goods and medical specimens. Such bags are generally made by joining thin plastic film panels so as to form the bag and range in size and holding capacity. Such bags are also typically manufactured having specific structural components and shapes suited for their intended use. One type of plastic film bag which is today commonly used is initially open for placing a product or item therein and is, thereafter, easily selectively closeable. In the event the item placed in the bag includes or contains liquids, it is desirable that the bag and closure seal be leakproof. It is further desirable that the closure seal be generally secure and, after a product has been placed therein and the bag closed, when desired, the bag can be opened for gaining access to the product therein.

One type of selectively closeable and leakproof plastic film bag is shown in U.S. Pat. No. 4,932,791 and U.S. Pat. No. 5,711,751. These patents disclose plastic film bags formed with front and rear plastic film walls joined together so as to form a bag having a bottom, side edges and an opening between the wall top edges. An adhesive strip is provided on the inside surface of one of the walls and extends linearly near the top edges from side edge to side edge. A release liner is provided which extends the full width of the bag from side edge to side edge but is partially notched at its longitudinal ends for creating a shortened longitudinal portion which is placed within the bag between the front and rear walls and over the adhesive strip. The liner shortened longitudinal portion is generally equally spaced between the bag side edges so that the bag is retained open whereat the release liner is located over the adhesive strip while, at each side edge, the adhesive strip is in contact with both the front and rear walls. By pulling the release liner out from between the front and rear walls, the adhesive strip is exposed to the inside surface of the other wall for thereby selectively adhering or attaching together the front and rear walls along the bag opening and closing the bag.

Although these prior art bags are generally suited for their intended purpose, because the release liner shortened longitudinal portion projects into the bag opening and over the linear strip of adhesive, it is quite often difficult to initiate or start the removal of the release liner thereat. Additionally, because the release liner extends to the bag side edges, a special release liner material is required so that, during production of such bags and the simultaneous cutting of the front and rear panels along the side edges and fusing the front and rear panels thereat, the silicone prevents fusing of the release liner to the front and rear walls at the side edges. Further yet, production of such bags is generally difficult because, as the plastic film webs forming the front and rear walls are located against one another and the adhesive strip is placed on the web surface that will become the interior surface of one of these walls, the release liner having previously been notched and having a freely extending shortened longitudinal portion must be placed, not only by properly projecting the shortened longitudinal portion the correct distance into the bag from the top edges but, also, properly locating the release liner notches so as to be aligned with the area whereat the cutting and fusing knife will thereafter cut and fuse the plastic film webs to form the bag side edges.

Accordingly, a need exists for a selectively closeable plastic film bag which is more readily and easily usable when placing product therein and closing the bag, and which can generally more easily, reliably, and inexpensively be manufactured.

SUMMARY OF THE INVENTION

A primary object of the present invention is to provide a new and improved selectively closeable plastic film bag which overcomes the above-discussed disadvantages and drawbacks associated with prior selectively closeable plastic film bags.

The present invention is directed to a new and improved selectively closeable plastic film bag having front and rear plastic film panels which together form a bag having a bottom and side edges. The bag has an opening between the front and rear panels top edges leading to a bag cavity between the front and rear panels. A strip of adhesive material is provided on the inside surface of either the front or rear panels extending uninterrupted from each of the bag side edges up toward the front and rear panels top edges and along the bag opening for the entire width of the bag. Preferably, the adhesive strip extends from each of the side edges at an angle up toward the front and rear panels top edges and, thereafter, extends generally linearly along the bag opening parallel to the front and rear panels top edges. A release liner strip which is detachably attachable to the adhesive material and which includes a generally linear bottom edge is provided between the front and rear panels with its bottom edge located partially over or vertically above the adhesive strip at each of the bag side edges. The release liner bottom edge essentially crosses over the adhesive strip whereat the adhesive strip extends at an angle upwardly from each side edge toward the front and rear panels top edges so that the release liner bottom edge is located below the adhesive strip linear portion. The release liner is, thus, over the adhesive strip other than near each side edge. Accordingly, the front and rear panels are retained detached from each other for the distance that the release liner is located over the adhesive strip thereby providing an opening wherethrough the bag cavity may be accessed for placing a product or item therein.

For closing the bag, the release liner strip is merely removed from between the front and rear panels thereby exposing the adhesive strip to the inside surfaces of both the front and rear panels and closing the bag by bringing the front and rear panels together in contact with the adhesive strip. Because the front and rear panels are fused together or are otherwise hermetically connected to each other at the bag bottom and side edges and the adhesive strip extends continuously from one side edge to the other, the bag closure as well as the bag itself is essentially leakproof. Additionally, because the release liner bottom edge intersects the adhesive strip preferably in the area whereat the adhesive extends at an angle upwardly from the side edges toward the front and rear panels top edges, the force required to initiate removal of the release liner is decreased thereby also making the removal of the release liner from between the front and rear panels generally easier.

In one embodiment, the release liner extends above the top edges of the front and rear panels whereat it is easily gripped for pulling out from between the front and rear panels. Additionally, the front and rear panels and the release liner are cut away at each of the bag side edges above the adhesive thereby preventing the inadvertent fusion or adhesion of the release liner to the front and rear panels at the bag side edges. In another embodiment, the front and rear panels are cut away at each of the bag side edges above the adhesive thereby forming a notched area, and the release liner extends into this notched area whereat it may be easily gripped and pulled out from between the front and rear panels.

A bottom pocket panel may be attached to the bag at the bottom and side edges so as to form a bottom pocket having an opening for selectively placing another product or, for example, an identification card therein. A top pocket may also be provided and attached to the bag at the top edge of the front panel and along the side edges of the bag with an opening generally adjacent the bottom pocket opening such that, for example, the top portion of an identification card can be received therein. The front and rear panels may each further be provided with a weakened material line extending between the side edges below the adhesive strip so that, after a product has been placed in the bag cavity and the bag closed, the product may be removed therefrom by tearing the front and rear panels along the weakened material lines and thereby opening the bag and gaining access to the bag cavity.

In one form thereof, the present invention is directed to a selectively closeable plastic film bag including front and rear plastic film panels forming a bag having a bottom and side edges. Each of the panels have top edges and an opening between the top edges leading to a cavity between the front and rear panels. An adhesive strip is provided between the front and rear panels extending from each of the side edges up toward the front and rear panels top edges and between the side edges. A release liner is provided between the front and rear panels and is located partially over or above the adhesive strip at the side edges and over the adhesive at an area between the side edges. The release liner is detachably attachable to the adhesive. In this manner, the front and rear panels are retained detached at the area whereat the release liner is located over the adhesive and, upon detachment of the release liner from the adhesive strip, the front and rear panels are selectively attachable to one another with the adhesive at the area between the side edges whereat the release liner was located over the adhesive.

In one form thereof, the present invention is directed to a selectively closeable plastic film bag including front and rear plastic film panels forming a bag having bottom and side edges. Each of the panels have top edges and an opening is provided between the top edges leading to a cavity between the front and rear panels. An adhesive strip is provided between the front and rear panels extending from each of the side edges up toward the front and rear panels top edges and between the edges. The adhesive strip extends uninterrupted between the side edges and includes a generally linear portion between the adhesive portions extending up toward the panels top edges. A release liner is provided between the front and rear panels. The release liner has a generally linear bottom edge extending partially over or above the adhesive strip at the side edges and below the linear portion of the adhesive strip. The release liner is detachably attachable to the adhesive whereby the front and rear panels are retained detached at the area whereat the release liner bottom edge is located below the adhesive. Upon detachment of the release liner from the adhesive strip, the front and rear panels are selectively attachable to one another with the adhesive at the area between the side edges whereat the release liner bottom edge was located below the adhesive.

BRIEF DESCRIPTION OF THE DRAWINGS

The above-mentioned and other features and objects of this invention and the manner of obtaining them will become more apparent and invention itself will be better understood by reference to the following description of embodiments of the invention taken in conjunction with the accompanying drawings wherein.

Corresponding reference characters indicate corresponding parts throughout the several views of the drawings.

Figure 2:
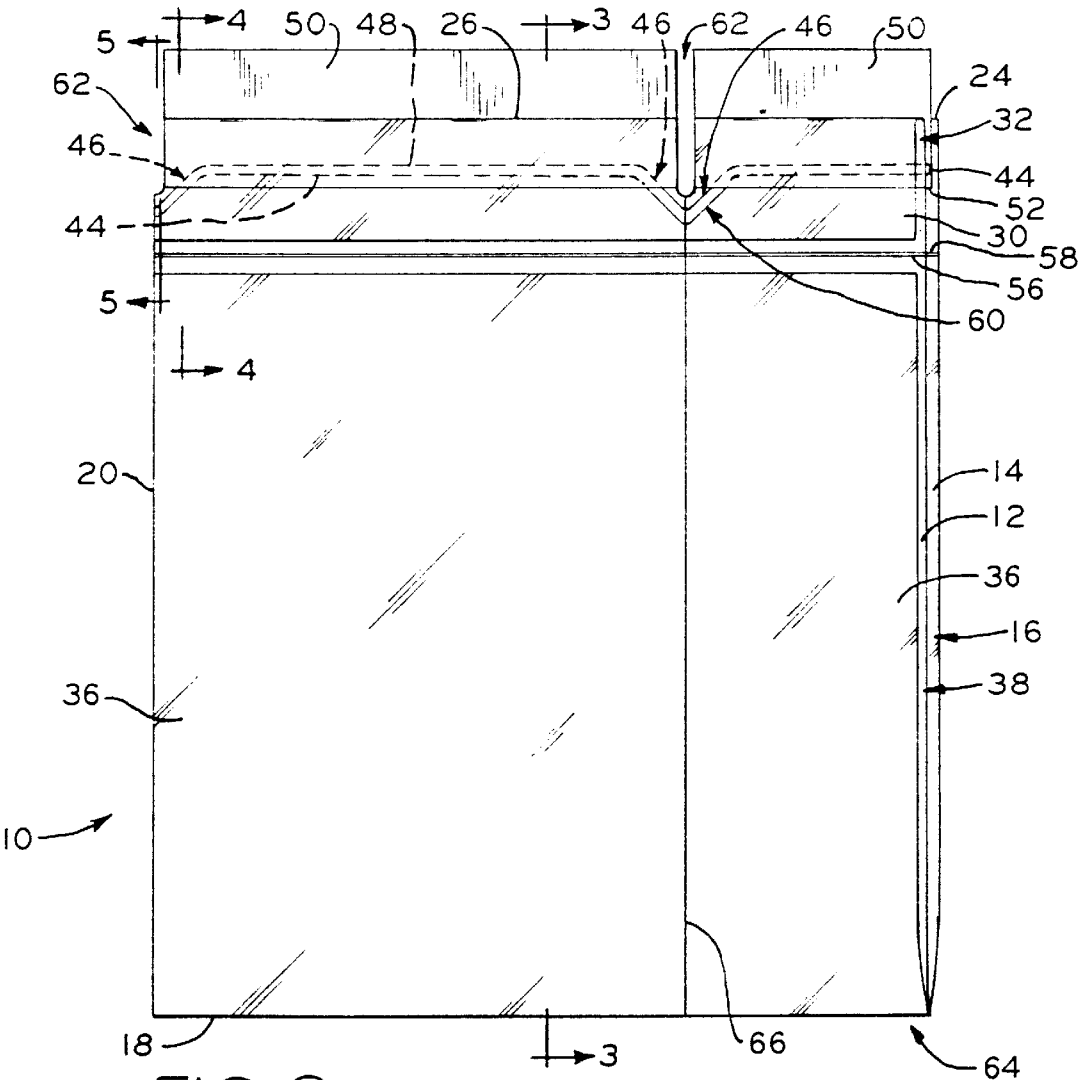
FIG. 2 is a side elevation view of the bag shown in FIG. 1 and shown in the manufacturing process just prior to cutting it away from another bag and fusing the front and rear panels thereat to form the bag side edges.

The exemplifications set out herein illustrate preferred embodiments of the invention in one form thereof and such exemplifications are not to be construed as limiting the scope of the disclosure or the scope of the invention in any manner.

DETAILED DESCRIPTION OF THE PREFERRED EMBODIMENT

Referring initially to FIGS. 1 through 7, there is shown a selectively closeable plastic film bag generally designated by the numeral 10 and constructed in accordance with the principles of the present invention. Bag 10 is made up of and includes a front panel or wall 12 and a rear panel or wall 14 which together form a bag cavity 16 therebetween and wherein various products or things such as medical specimens may be placed or stored. Panels 12 and 14 are made of thin plastic film of polyethylene or synthetic resin suitable for forming such bags and are typically generally translucent. The bag forming cavity 16 essentially includes a bottom 18 and side edges including a left side edge 20 and a right side edge 22. Preferably, front and rear panels 12 and 14 are made of a single sheet or web of plastic film which is folded over to form the bottom or bottom edge 18 as shown. At the side edges 20 and 22, the front and rear panels 12 and 14 are preferably joined together by thermal fusion, heat sealing or other suitable means. It is noted, however, that depending on the manufacturing process, any one of the side edges 20 or 22 or the bottom edge 18 can be either a folded over edge or a heat sealed/fused edge between the front and rear panels 12 and 14. So as to form a leakproof cavity 16, the heat sealing or fusing of the front and rear panels 12 and 14 should be sufficient to not only hold the product or item within the cavity 16 but, also, to assure that any liquid therein will not escape therethrough.

Figure 1:
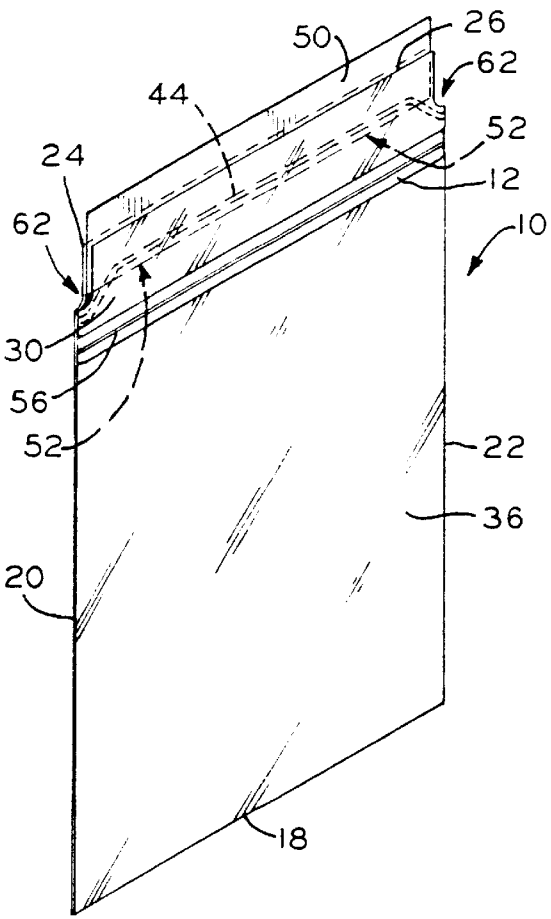
FIG. 1 is a perspective view of a selectively closeable plastic film bag constructed in accordance with the principles of the present invention.
Figure 3:
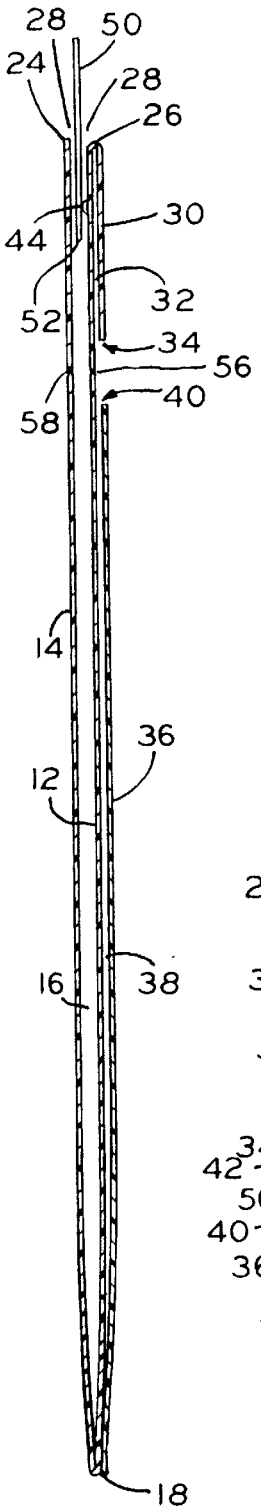
FIG. 3 is a cross sectional view of the bag shown in FIG. 2 taken along line 3—3.
Figure 4:
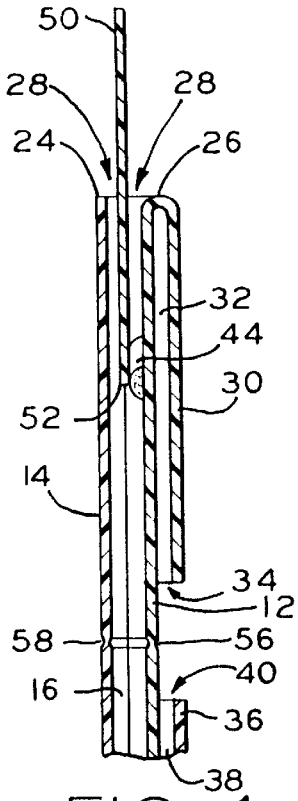
FIG. 4 is a partial cross sectional view of the bag shown in FIG. 2 taken along line 4—4.
Figure 5:
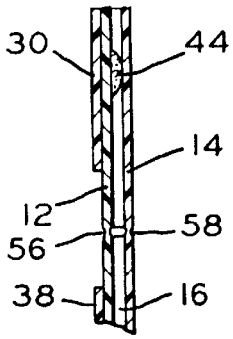
FIG. 5 is a partial cross sectional view of the bag shown in FIG. 2 taken along line 5—5.
Figure 7:
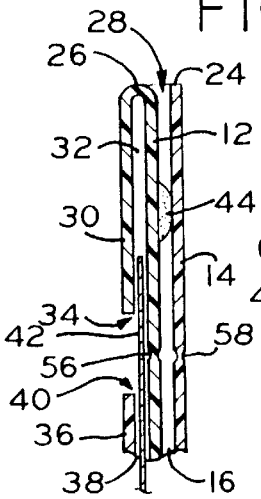
FIG. 7 is a partial cross sectional view of the closed part of the bag shown in FIG. 6 taken along line 7—7.
Figure 6:
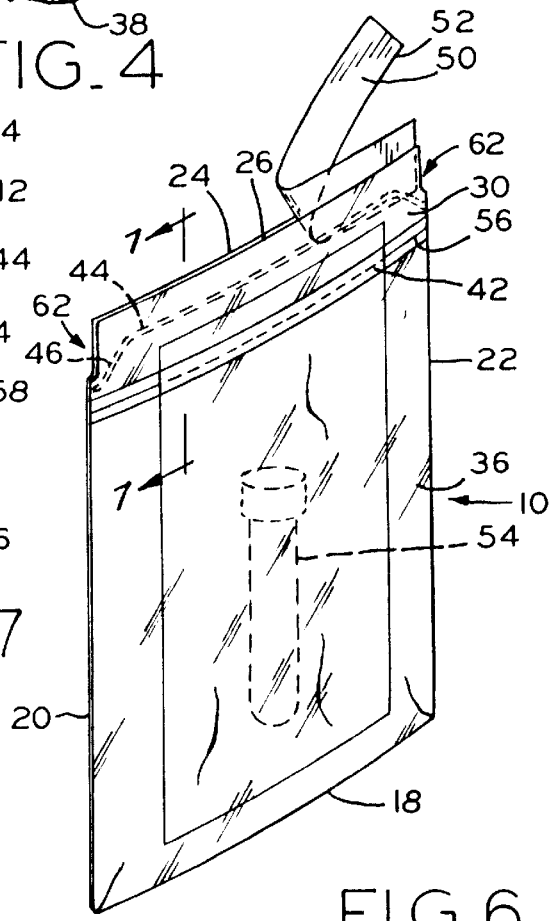
FIG. 6 is a perspective view of the bag shown in FIG. 1 after a product has been placed in the bag cavity and an identification card has been placed in the bag pockets and, further, showing the release liner being removed from between the front and rear panels for closing the bag.

The front and rear panels 12 and 14 further include top edges, namely, back panel top edge 24 and front panel top edge 26. Top edges 24 and 26 are not joined to one another thus forming an opening 28 thereat leading to the cavity 16 between front and rear panels 12 and 14. Preferably, the plastic film material forming the front panel 12 is folded over at the top edge 26 as shown for providing a top pocket panel 30. Top pocket panel 30 is similarly heat sealed or fused at side edges 20 and 22 so as form a top pocket 32 in front of front panel 12. Top pocket 32 is accessible through opening 34 which, as best seen and FIGS. 1, 2 and 6, extends from left side edge 20 to right side edge 22. A bottom pocket panel 36 is also provided and is attached at the bottom edge 18 and side edges 20 and 22 by heat sealing or fusing so as to thereby form a bottom pocket 38. Similar to top pocket 32, the bottom pocket 38 is accessible through an opening 40 which extends, as best seen in FIGS. 1, 2 and 6, from left side edge 20 to right side edge 22. Although the preferred embodiment is as shown, depending on the manufacturing process, the top pocket panel 30 and bottom pocket panel 38 can be attached utilizing one or more folded over edges such as the folded top edge 26 or by heat sealing/fusing.

Referring to FIG. 6, pockets 32 and 38 are preferably provided for insertion and holding of an identification or instruction card 42 therein. As shown, pocket openings 34 and 40 are adjacent but spaced from one another leaving a longitudinal gap therebetween from left side edge 20 to right sided edge 22 whereat the card 42 may be inserted down into the bottom pocket 38 through opening 40 and then tucked up into the top pocket 32 through opening 34. Top pocket panel 30 as well as bottom pocket panel 36 are also preferably made of thin plastic film of polyethylene or synthetic resin which is generally translucent such that writing or other markings on the card 42 are readily visible therethrough.

An adhesive strip 44 is applied and provided between the front and rear panels 12 and 14 at the opening 28 of bag 10 and extending from left side edge 20 to right side edge 22. Adhesive strip 44 is provided in a pattern as shown wherein, from each of the side edges 20 and 22, the adhesive strip 44 extends upwardly toward the top edges 24 and 26 of panels 14 and 12. Preferably, adhesive strip 44 extends upwardly at an angle from the side edges 20 and 22 as shown and depicted by the adhesive portion generally designated by the numeral 46. Preferably, the adhesive strip 44 includes a linear adhesive portion 48 which extends between the angled adhesive portions 46 as shown and generally parallel to the panels top edges 24 and 26. Adhesive strip 44 is further preferably applied continuously or uninterrupted from side edge 20 to side edge 22. The adhesive of adhesive strip 44 is a tacky generally pliable material such as a hot melt adhesive available from National Starch and Chemical which readily adheres to the surfaces of front and rear panels 12 and 14. As shown, adhesive strip 44 is applied to the inside surface of the front panel 12 although, as can be appreciated, depending on the manufacturing process, the adhesive strip 44 could just as easily be applied to the inside surface of the rear panel 14.

A release liner 50 made of, for example, silicone covered or coated plastic film or paper is applied onto or over the adhesive strip 44 . Release liner 50 is retained thereat by the adhesive strip but does not stick or adhere thereto thereby essentially making the release liner 50 selectively detachably attachable to the adhesive strip 44. As shown, release liner 50 is provided and located between the front and rear panels 12 and 14 at the opening 28 with a portion thereof extending above the top edges 24 and 26 of panels 12 and 14. Release liner 50 has a generally a linear bottom edge 52 which, as best seen in FIG. 2, at each of the side edges 20 and 22 is located above the adhesive strip 44 and then, after crossing over the angled adhesive portions 46, is located below the linear adhesive portion 48. Thus, release liner 50 is located over the adhesive strip 44 along the entire length of the linear adhesive portion 48 and a part of the angled adhesive portion 46 whereas, at each side edge 20 and 22, the adhesive of the angled adhesive portion 46 below the release liner bottom edge 52 leading to the respective side edge 20 and 22 is in contact with both of the front and rear panels 12 and 14. More particularly, because the adhesive strip extends to the fused side edges 20 and 22, the front and rear panels 12 and 14 are attached together by the adhesive strip 44 from the fused side edges 20 and 22 to the liner bottom edge 52 of the release liner 50. This provides a solid reliable interconnection between the front and rear panels at the side edges 20 and 22 near adhesive strip 44. However, above the liner bottom edge 52 and along the linear adhesive portion 48, the release liner 50 prevents the adhesive strip 44 from coming in contact with the inside surface of the rear panel 14 thereby retaining the bag 10 open. It is noted that, although it is preferable for the release liner bottom edge 52 to be located vertically above the adhesive strip 44 at each of the side edges 20 and 22 as shown, the width of the adhesive strip 44 can be increased or the bottom edge 52 lowered vertically such that the liner bottom edge 52 is located only partially over or partially covering the adhesive strip 44 at each side edge 20 and 22. A part of the adhesive strip 44 would still be located below the bottom edge 52 of the release liner 50 whereat the front end rear panels 12 and 14 would be attached by the adhesive at or near side edges 20 and 22 as contemplated by the principles of the present invention. As used herein, the terms "over" and "partially over" refer to the covering of or the release liner laying over the adhesive strip whereas, the terms "above" or "below" refer to the location of the release liner strip such as vertically above the adhesive toward the top edges or vertically therebelow.

As should now be appreciated, bag 10 is retained open in the area whereat release liner 50 is located over the adhesive strip 44 and is, thus, ready to receive a product or other item such as a medical specimen therein. After a product such as, for example, a test tube 54 is placed into the bag cavity 16 through the opening 28 between release liner 50 and rear panel 14, the bag 10 is selectively closed by merely removing the release liner 50 from between the front and rear panels 12 and 14. As depicted in FIG. 6, the release liner 50 is preferably gripped at one longitudinal end thereof and is pulled out from between the front and rear panels 12 and 14 thereby also exposing the adhesive strip 44 to the inside surface of the rear panel 14. By merely allowing the adhesive strip 44 to come in contact with the inside surface of rear panel 14 and or bringing the front and rear panels together with slight pressure thereat, the adhesive strip 44 effectively comes in contact with and adheres to the inside surface of both of the front and rear panels 12 and 14 thereby closing the opening 28 of the bag 10. Furthermore, because the adhesive strip 44 extends uninterrupted from side edge 20 to side edge 22, after closure, the cavity 16 is essentially leakproof.

For regaining access to the bag cavity 16 and removing the contents such as the test tube 54 therefrom, front and rear panels 12 and 14 are each provided with weakened material lines 56 and 58, each of which extend between the side edges 20 and 22 below the adhesive strip 44 and, preferably longitudinally along the area between openings 34 and 40 leading to pockets 32 and 38. Weakened material lines 56 and 58 are formed by compressing the plastic film material thereof between rollers (not shown) sufficiently for causing the material to be weakened but not pierced. In this manner, the bag may be retained leakproof but, when access to the contents within the cavity 16 is desired, the front and rear panels 12 and 14 are more readily and easily ripped or torn apart along the weakened material lines 56 and 58 for opening the bag 10. If a leakproof bag is not needed, perforation lines may be used rather than weakened material lines.

When producing the bags 10, prior to folding over the web of plastic film so as to form the front and rear panels 12 and 14 and as the web of plastic film is traveling longitudinally, the adhesive strip 44 is continuously placed onto the inside surface of the front or rear panels 12 or 14 in a pattern as best seen in FIG. 2. That is, as the web of plastic film moves longitudinally, the nozzle depositing the adhesive is shifted for creating a pattern of V-shapes or dips 60 between the adhesive linear portions 48. Thereafter, again prior to fully folding over the front and rear panels 12 and 14, the release liner strip 50 which is preferably a continues strip of material without any notches is applied over the adhesive strip locating the bottom edge 52 thereof so as to be vertically below the linear adhesive portions 48 but vertically above the bottom of the V-shaped portions 60. Then, the front and rear panels 12 and 14 are brought together allowing the inside surfaces thereof to be attached together by the adhesive V-shaped portions 60 below the release liner bottom edge 52. It is noted that, prior to bringing the front and rear panels 12 and 14 together, the plastic film web is also run through clamping rollers which essentially form the weakened material lines 56 and 58. With front and rear panels 12 and 14 now against one another and the adhesive strip 44 and release liner 50 in place between the front and rear panels 12 and 14 as shown in FIG. 2, the front and rear panels and the release liner are cut away or notched as indicated by the numeral 62 vertically above the V-shaped portion 60 and between what will become bag 10 and another bag 64 adjacent thereto. The cut away 62 preferably extends down to below the release liner bottom edge 52 but above the adhesive strip 44 at the V-shaped portion 60. Thereafter or simultaneously while severing the cut away or notch 62, bag 10 is severed away from the other or next bag 64 at severance line 66. Preferably, while severing bag 10 from bag 64, the front and rear panels 12 and 14 are simultaneously fused or heat sealed together thereat thereby also forming the fused right side edge 22 of bag 10 and fused left side edge 20 of bag 64. The cut away 62 prevents the release liner 50 from inadvertently adhering or otherwise becoming fused to the front and rear panels 12 and 14 thereby assuring that, when the release liner 50 is gripped and pulled out from therebetween, the release liner 50 is not somehow attached to the front and rear panels at the release liner longitudinal ends. It is further noted that by placing the adhesive strip on the back wall 14 and placing the release liner 50 thereon as described, the cut away 62 can be made only on the rear panel 14 and release liner 50. This prevents the inadvertent adherence of liner 50 to the front panel 12 while not punching a hole in pocket 32 at each side edge 20 and 22.

Figure 9:
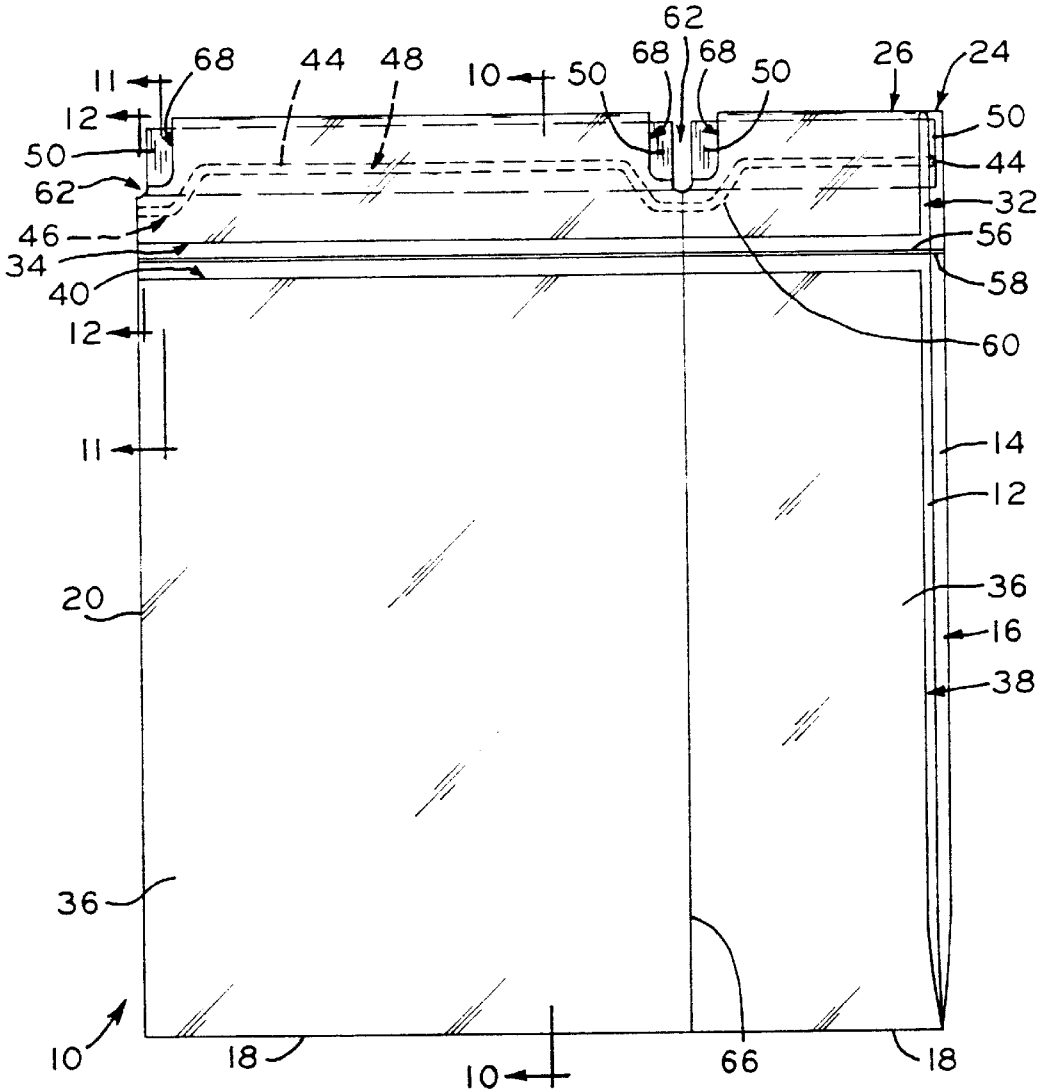
FIG. 9 is a side elevation view of the bag shown in FIG. 8 and shown in the manufacturing process just prior to cutting it away from another bag and fusing the front and rear panels thereat to form the bag side edges.

In the second embodiment shown in FIGS. 8 through 12, the bag 10 is essentially identical to that shown and described in FIGS. 1 through 7, except that the release liner 50 does not extend vertically above the top edges 24 and 26 of front and rear walls 12 and 14. Rather, when the bags of this embodiment are manufactured, as best seen in FIG. 9, the front and rear panels 12 and 14 are fist notched or cut away so as to form a larger or wider notch or cut away 68 and, thereafter, the release liner 50 is placed between the front and rear panels 12 and 14 and on the adhesive strip 44. Then, with the release liner 50 sandwiched between the front and rear panels 12 and 14, the notch or cut away 62 is made for primarily cutting away the release liner 50 but, also, again extending and cutting below the release liner bottom edge 52 and at least partially cutting away the front and rear panels 12 and 14 thereat as shown. In this manner, when the bags are cut along severance line 66 and the front and rear panels are fused thereat, again, the release liner is not inadvertently fused or sealed to the front or rear panels 12 and 14 and is freely removable from therebetween.

Figure 8:
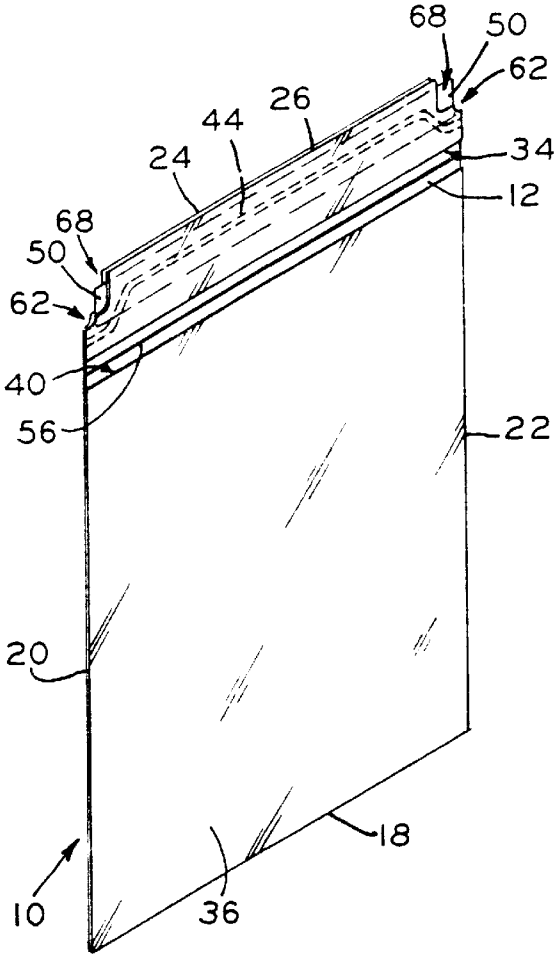
FIG. 8 is a perspective view of a second embodiment of a selectively closeable plastic film bag constructed in accordance with the principles of the present invention.
Figure 10:
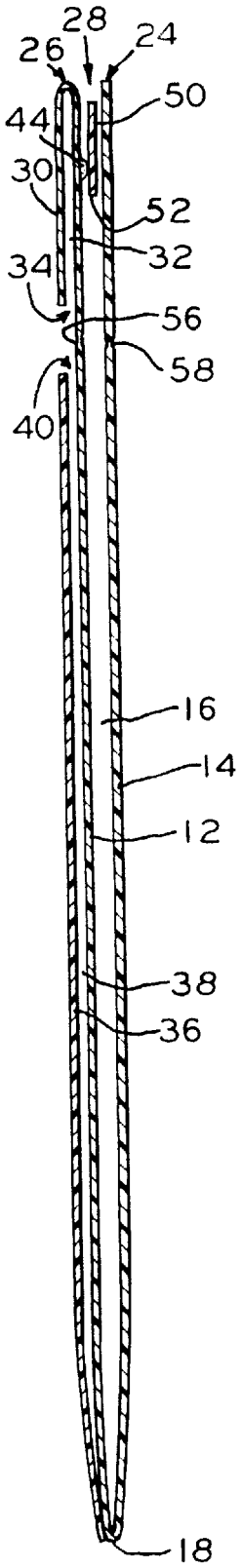
FIG. 10 is a cross sectional view of the bag shown in FIG. 9 taken along line 10—10.
Figure 11:
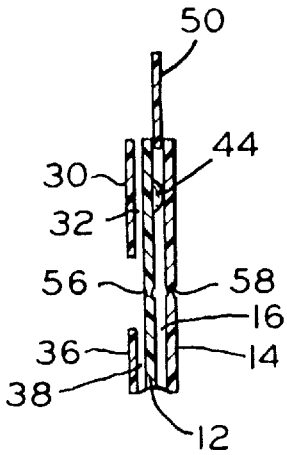
FIG. 11 is a partial cross sectional view of the bag shown in FIG. 9 taken along line 11—11; and, FIG. 12 is a partial cross sectional view of the bag shown in FIG. 9 taken along line 12—12.
Figure 12:
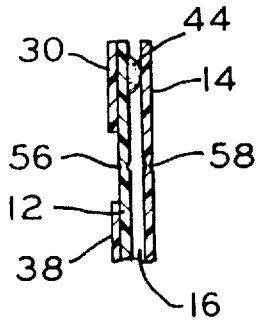

In the embodiment of FIG. 9, as shown, the release liner extends out from between the front and rear panels 12 and 14 and into the larger notched area 68 whereat it may be gripped by the user after a product has been placed within the bag cavity 16 so as to remove the release liner 50 from therebetween and close the bag along the adhesive strip as more fully discussed hereinabove. As best seen in FIGS. 8 and 9, so as to accommodate the large notch 68 of the second embodiment, the adhesive strip may initially extend generally perpendicular from the side edges 20 and 22 prior to extending upwardly at an angle or, in the alternative, adhesive strip may extend upwardly at a shallower angle from side edges 20 and 22 so as to avoid coming in contact with the larger notches 68. In any event, as should be evident, the longitudinal length of the adhesive strip 44 being covered by the release liner 50 in this embodiment is relatively somewhat shorter in length in view of the notches 68 at each of the side edges 20 and 22. Although the embodiment of FIGS. 8 through 12, may be considered by some to be more compact and desirable in view of the release liner 50 not extending above the panels edges 24 and 26, it is contemplated that the release liner 50 in the embodiment of FIGS. 8 through 12 could also extend above the edges 24 and 26 thereby providing the option to grip the release liner thereat as well.

While the invention has been described as having specific embodiments, it will be understood that it is capable of further modifications. This application is, therefore, intended to cover any variations, uses, or adaptations of the invention following the general principles thereof and including such departures from the present disclosure as come within known or customary practice in the art to which this invention pertains and fall within the limits of the appended claims.

What is claimed is:

1. A selectively closeable plastic film bag comprising:

front and rear plastic film panels forming a bag having a bottom and side edges, each of said panels having top edges;

an opening between said top edges leading to a cavity between said front and rear panels;

an adhesive strip between said front and rear panels extending from each of said side edges up toward said front and rear panels top edges and between said side edges;

a release liner between said front and rear panels located partially over or above said adhesive strip at said side edges and over said adhesive strip at an area between said side edges; and, wherein said release liner is detachably attachable to said adhesive, whereby said front and rear panels are retained detached at said area whereat said release liner is located over said adhesive and whereby, upon detachment of said release liner from said adhesive strip, said front and rear panels are selectively attachable to one another with said adhesive at said area between said side edges whereat said release liner was located over said adhesive.

2. The selectively closeable plastic film bag of claim 1 wherein said release liner has a generally linear bottom edge extending over or above said adhesive strip at said side edges and below said adhesive strip at said area between said side edges.

3. The selectively closeable plastic film bag of claim 2 wherein said release liner bottom edge extends above said adhesive strip at said side edges.

4. The selectively closeable plastic film bag of claim 1 wherein said adhesive strip extends uninterrupted between said bag side edges whereby, upon removing said release liner and attaching said front and rear panels to one another, said bag cavity is substantially leakproof.

5. The selectively closeable plastic film bag of claim 4 wherein said adhesive strip includes a generally linear portion between said adhesive portions extending up toward said panels top edges.

6. The selectively closeable plastic film bag of claim 5 wherein said release liner extends above at least one of said top edges of said front or rear panels, whereby the liner may be gripped and pulled out from between said front and rear panels.

7. The selectively closeable plastic film bag of claim 6 wherein said release liner extends above both said top edges of said front and rear panels.

8. The selectively closeable plastic film bag of claim 7 wherein said front and rear panels and said release liner are cut away at said side edges above said adhesive, whereby said release liner is prevented from inadvertently adhering to said front or rear panels at said side edges.

9. The selectively closeable plastic film bag of claim 7 further comprising a pocket panel attached to said bag at said bottom and said side edges forming a pocket and having an opening for selectively placing a product therein.

10. The selectively closeable plastic film bag of claim 9 wherein said front and rear panels include weakened material lines extending between said side edges below said adhesive strip whereat said front and rear panels are selectively separable for opening the bag and gaining access to said bag cavity.

11. The selectively closeable plastic film bag of claim 10 further comprising a pocket panel attached to said bag at said bottom and said side edges forming a pocket and having an opening for selectively placing a product therein.

12. The selectively closeable plastic film bag of claim 5 wherein at least one of said front and rear panels are cut away at said side edges above said adhesive forming a notched area and wherein said release liner extends into said notched area, whereby said release liner may be gripped and pulled out from between said front and rear panels.

13. The selectively closeable plastic film bag of claim 12 wherein both of said front and rear panels are cut away at said side edges above said adhesive and forming said notched area wherein said release liner extends, whereby said release liner may be gripped and pulled out from between said front and rear panels.

14. The selectively closeable plastic film bag of claim 13 wherein said front and rear panels and said release liner are cut away above said adhesive at said side edges.

15. The selectively closeable plastic film bag of claim 13 further comprising a pocket panel attached to said bag at said bottom and said side edges forming a pocket and having an opening for selectively placing a product therein.

16. The selectively closeable plastic film bag of claim 13 wherein said front and rear panels include weakened material lines extending between said side edges below said adhesive strip whereat said front and rear panels are selectively separable for opening the bag and gaining access to said bag cavity.

17. The selectively closeable plastic film bag of claim 16 further comprising a pocket panel attached to said bag at said bottom and said side edges forming a pocket and having an opening for selectively placing a product therein.

18. The selectively closeable plastic film bag of claim 2 wherein said adhesive strip includes a generally linear portion between said adhesive portions extending up toward said panels top edges.

19. The selectively closeable plastic film bag of claim 18 wherein said release liner extends above at least one of said top edges of said front or rear panels, whereby the liner may be gripped and pulled out from between said front and rear panels.

20. The selectively closeable plastic film bag of claim 18 wherein at least one of said front and rear panels are cut away at said side edges above said adhesive forming a notched area and wherein said release liner extends into said notched area, whereby said release liner may be gripped and pulled out from between said front and rear panels.

21. The selectively closeable plastic film bag of claim 1 wherein said adhesive strip extends uninterrupted between said bag side edges whereby, upon removing said release liner and attaching said front and rear panels to one another, said bag cavity is substantially leakproof.

22. The selectively closeable plastic film bag of claim 21 wherein said release liner extends above at least one of said top edges of said front or rear panels, whereby the liner may be gripped and pulled out from between said front and rear panels.

23. The selectively closeable plastic film bag of claim 22 wherein said release liner extends above both said top edges of said front and rear panels.

24. The selectively closeable plastic film bag of claim 23 wherein said front and rear panels and said release liner are cut away at said side edges above said adhesive, whereby said release liner is prevented from inadvertently adhering to said front or rear panels at said side edges.

25. The selectively closeable plastic film bag of claim 23 further comprising a pocket panel attached to said bag at said bottom and said side edges forming a pocket and having an opening for selectively placing a product therein.

26. The selectively closeable plastic film bag of claim 23 wherein said front and rear panels include weakened material lines extending between said side edges below said adhesive strip whereat said front and rear panels are selectively separable for opening the bag and gaining access to said bag cavity.

27. The selectively closeable plastic film bag of claim 21 wherein at least one of said front and rear panels are cut away at said side edges above said adhesive forming a notched area and wherein said release liner extends into said notched area, whereby said release liner may be gripped and pulled out from between said front and rear panels.

28. The selectively closeable plastic film bag of claim 27 wherein both of said front and rear panels are cut away at said side edges above said adhesive and forming said notched area wherein said release liner extends, whereby said release liner may be gripped and pulled out from between said front and rear panels.

29. The selectively closeable plastic film bag of claim 28 wherein said front and rear panels include weakened material lines extending between said side edges below said adhesive strip whereat said front and rear panels are selectively separable for opening the bag and gaining access to said bag cavity.

30. The selectively closeable plastic film bag of claim 28 further comprising a pocket panel attached to said bag at said bottom and said side edges forming a pocket and having an opening for selectively placing a product therein.

31. The selectively closeable plastic film bag of claim 1 wherein said release liner extends above at least one of said top edges of said front or rear panels, whereby the liner may be gripped and pulled out from between said front and rear panels.

32. The selectively closeable plastic film bag of claim 31 wherein said front and rear panels and said release liner are cut away at said side edges above said adhesive, whereby said release liner is prevented from inadvertently adhering to said front or rear panels at said side edges.

33. The selectively closeable plastic film bag of claim 31 wherein said release liner extends above both said top edges of said front and rear panels.

34. The selectively closeable plastic film bag of claim 33 wherein said front and rear panels and said release liner are cut away at said side edges above said adhesive, whereby said release liner is prevented from inadvertently adhering to said front or rear panels at said side edges.

35. The selectively closeable plastic film bag of claim 1 wherein said front and rear panels include weakened material lines extending between said side edges below said adhesive strip whereat said front and rear panels are selectively separable for opening the bag and gaining access to said bag cavity.

36. The selectively closeable plastic film bag of claim 1 further comprising a pocket panel attached to said bag at said bottom and said side edges forming a pocket and having an opening for selectively placing a product therein.

37. The selectively closeable plastic film bag of claim 36 further comprising a second pocket panel attached to said bag at a top edge of said front or rear panels and said two side edges forming a pocket and having an opening generally adjacent to said first pocket opening.

38. The selectively closeable plastic film bag of claim 37 wherein said pocket openings are adjacent but spaced from each other and said front and rear panels include weakened material lines extending between said side edges below said adhesive strip and between said pocket openings whereat said front and rear panels are selectively separable for opening the bag and gaining access to said bag cavity.

39. The selectively closeable plastic film bag of claim 1 wherein said adhesive strip includes a generally linear portion between said adhesive portion extending up toward said panels top edges.

40. The selectively closeable plastic film bag of claim 1 wherein at least one of said front and rear panels are cut away at said side edges above said adhesive forming a notched area and wherein said release liner extends into said notched area, whereby said release liner may be gripped and pulled out from between said front and rear panels.

41. The selectively closeable plastic film bag of claim 40 wherein both of said front and rear panels are cut away at said side edges above said adhesive and forming said notched area wherein said release liner extends, whereby said release liner may be gripped and pulled out from between said front and rear panels.

42. The selectively closeable plastic film bag of claim 41 wherein said front and rear panels and said release liner are cut away above said adhesive at said side edges.

43. A selectively closeable plastic film bag comprising;

front and rear plastic film panels forming a bag having a bottom and side edges, each of said panels having top edges;

an opening between said top edges leading to a cavity between said front and rear panels;

an adhesive strip between said front and rear panels extending from each of said side edges up toward said front and rear panels top edges and between said edges, said adhesive strip extending uninterrupted between said side edges and including a generally linear portion between said adhesive portions extending up toward said panels top edges;

a release liner between said front and rear panels, said release liner having a generally linear bottom edge extending partially over or above said adhesive strip at said side edges and below said linear portion of said adhesive strip; and, wherein said release liner is detachably attachable to said adhesive, whereby said front and rear panels are retained detached at said area whereat said release liner is located below said adhesive and whereby, upon detachment of said release liner from said adhesive strip, said front and rear panels are selectively attachable to one another with said adhesive at said area between said side edges whereat said release liner was located below said adhesive.

44. The selectively closeable plastic film bag of claim 43 wherein said front and rear panels are cut away at said side edges above said adhesive forming a notched area and wherein said release liner extends into said notched area, whereby said liner may be gripped and pulled out from between said front and rear panels.

45. The selectively closeable plastic film bag of claim 44 further comprising a pocket panel attached to said bag at said bottom and said side edges forming a pocket and having an opening for selectively placing a product therein.

46. The selectively closeable plastic film bag of claim 44 wherein said front and rear panels include weakened material lines extending between said side edges below said adhesive strip whereat said front and rear panels are selectively separable for opening the bag and gaining access to said bag cavity.

47. The selectively closeable plastic film bag of claim 43 wherein said release liner extends above said top edges of said front and rear panels whereby the liner may be gripped and pulled out from between said front and rear panels and wherein said front and rear panels and said release liner are cut away at said side edges above said adhesive, whereby said release liner is prevented from inadvertently adhering to said front or rear panels at said side edges.

48. The selectively closeable plastic film bag of claim 47 further comprising a pocket panel attached to said bag at said bottom and said side edges forming a pocket and having an opening for selectively placing a product therein.

49. The selectively closeable plastic film bag of claim 47 wherein said front and rear panels include weakened material lines extending between said side edges below said adhesive strip whereat said front and rear panels are selectively separable for opening the bag and gaining access to said bag cavity.

* * * * *